US005421089A

United States Patent [19]

Dubus et al.

[11] Patent Number: 5,421,089

[45] Date of Patent: Jun. 6, 1995

[54] FORK WITH TIMER

[76] Inventors: Nicole M. Dubus; Susan Springfield, both of 132 Castillion Ter., Santa Cruz, Calif. 95060

[21] Appl. No.: 249,191

[22] Filed: May 26, 1994

[51] Int. Cl.[6] ..... A47J 43/28

[52] U.S. Cl. ..... 30/142; 30/322

[58] Field of Search ..... 30/123, 142, 324, 137, 30/147, 148, 149, 150, 322; 446/81, 175

[56] References Cited

U.S. PATENT DOCUMENTS

| | | | |
|---|---|---|---|
| 4,207,673 | 6/1980 | DiGirolamo et al. | 30/142 |
| 4,914,819 | 4/1990 | Ash | 30/147 |
| 5,075,970 | 12/1991 | Albert | 30/123 |
| 5,189,793 | 3/1993 | Ratzon et al. | 30/123 |

*Primary Examiner*—Hwei Siu Payer

[57] ABSTRACT

A fork with timer comprising a fork having a head, a plurality of spaced tines extended from the head, and a handle extended from the head remote from the tines; timer circuitry connected to the handle of the fork and adapted for providing a cue after an elapsed period of time for indicating to user that another bite of food using the fork may be taken; a replaceable power source connected to the fork and coupled to the timer circuitry with the power source adapted for energizing the timer circuitry; and a switch connected to the fork and coupled between the power source and the timer circuitry with the switch having one orientation for energizing the timer circuitry and another orientation for de-energizing the timer circuitry.

4 Claims, 3 Drawing Sheets

FORK WITH TIMER

BACKGROUND OF THE INVENTION

1. Field of the Invention

The present invention relates to a fork with timer and more particularly pertains to providing a cue to a user after an elapsed period of time for indicating that another bite of food using the fork may be taken with a fork with timer.

2. Description of the Prior Art

The use of forks is known in the prior art. More specifically, forks heretofore devised and utilized for the purpose of eating are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 245,141 to Eldridge et al. discloses a fork or other similar article of flatware. U.S. Pat. Des. No. 275,167 to Laslo discloses a fork. U.S. Pat. Des. No. 337,701 to Wilson discloses a fork. U.S. Pat. No. 3,609,865 to Golden discloses a fork-like food utensil. U.S. Pat. No. 4,896,423 to Kinsey discloses an eating fork.

While these devices fulfill their respective, particular objective and requirements, the aforementioned patents do not describe a fork with timer that provides a cue to a user after an elapsed period of time for indicating that another bite of food using the fork may be taken.

In this respect, the fork with timer according to the present invention substantially departs from the conventional concepts and designs of the prior art, and in doing so provides an apparatus primarily developed for the purpose of providing a cue to a user after an elapsed period of time for indicating that another bite of food using the fork may be taken.

Therefore, it can be appreciated that there exists a continuing need for new and improved fork with timer which can be used for providing a cue to a user after an elapsed period of time for indicating that another bite of food using the fork may be taken. In this regard, the present invention substantially fulfills this need.

SUMMARY OF THE INVENTION

In the view of the foregoing disadvantages inherent in the known types of forks now present in the prior art, the present invention provides an improved fork with timer. As such, the general purpose of the present invention, which will be described subsequently in greater detail, is to provide a new and improved fork with timer and method which has all the advantages of the prior art and none of the disadvantages.

To attain this, the present invention essentially comprises, in combination, a rigid fork having a head, four spaced and aligned tines extended from the head, and a handle extended from the head remote from the tines for allowing a user a firm grip for taking a bite of food. Timer circuitry is connected to the handle of the fork and adapted for providing a cue after an elapsed period of time for indicating to user that another bite of food using the fork may be taken.

The timer circuitry includes a countdown timer adapted for counting down a pre-programmed period of time, transmitting countdown signals in sequence during this period of time, and transmitting an event signal when this period of time has elapsed with the countdown timer including automatic reset circuitry for resetting the pre-programmed period of time upon countdown completion for subsequent countdown during a subsequent period of time. The timer circuitry includes decoder/driver circuitry coupled to the countdown timer and adapted for receiving the countdown signals and event signals during and upon completion of a period of time, transmitting a "go" signal when an event signal is received, transmitting a "stop" signal when an event signal is not received, and transmitting timer display signals upon receipt of countdown signals. The timer circuitry includes a green light emitting diode and a red light emitting diode each coupled to the decoder/driver circuitry with the green light emitting diode activated when the "go" signal is received and deactivated otherwise, the red light emitting diode activated when the "stop" signal is received and deactivated otherwise, whereby when a period of time has elapsed, the green light emitting diode is activated and the red light emitting diode is deactivated, and when a period of time has not elapsed, the red light emitting diode is activated and the green light emitting diode is deactivated. Lastly, the timer circuitry includes display circuitry coupled to the decoder/driver circuitry with the display circuitry having a numeric display for transmitting a visual indication of elapsed time based upon receipt of timer display signals.

A replaceable power source is connected to the fork and coupled to the timer circuitry with the power source adapted for energizing the timer circuitry. Lastly, a switch is connected to the handle of the fork and coupled between the power source and the timer circuitry with the switch having one orientation for energizing the timer circuitry and another orientation for de-energizing the timer circuitry.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fork with timer which has all the advantages of the prior art forks and none of the disadvantages.

It is another object of the present invention to provide a new and improved fork with timer which may be easily and efficiently manufactured and marketed.

It is a further object of the present invention to provide a new and improved fork with timer which is of durable and reliable construction.

An even further object of the present invention is to provide a new and improved fork with timer which is susceptible of a low cost of manufacture with regard to both materials and labor, and which accordingly is then susceptible of low prices of sale to the consuming public, thereby making such a fork with timer economically available to the buying public.

Still yet another object of the present invention is to provide a new and improved fork with timer which provides in the apparatuses and methods of the prior art some of the advantages thereof, while simultaneously overcoming some of the disadvantages normally associated therewith.

Even still another object of the present invention is to provide a new and improved fork with timer for providing a cue to a user after an elapsed period of time for indicating that another bite of food using the fork may be taken.

Lastly, it is an object of the present invention to provide a new and improved fork with timer comprising a fork having a head, a plurality of spaced tines extended from the head, and a handle extended from the head remote from the tines; timer circuitry connected to the handle of the fork and adapted for providing a cue after an elapsed period of time for indicating to a user that another bite of food using the fork may be taken; a replaceable power source connected to the fork and coupled to the timer circuitry with the power source adapted for energizing the timer circuitry; and a switch connected to the fork and coupled between the power source and the timer circuitry with the switch having one orientation for energizing the timer circuitry and another orientation for de-energizing the timer circuitry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
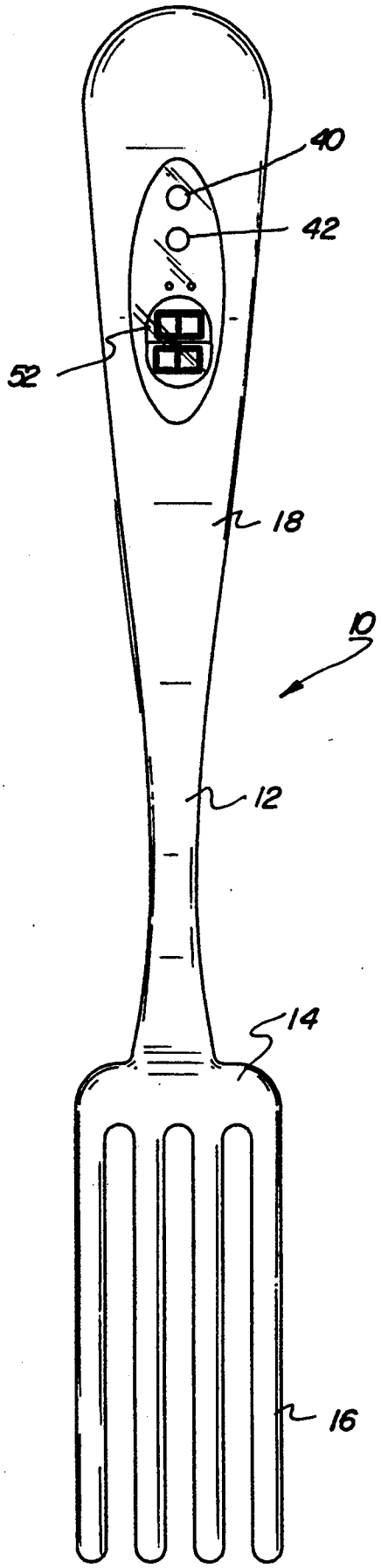
FIG. 1 is a plan view of the preferred embodiment constructed in accordance with the principles of the present invention.
Figure 2:
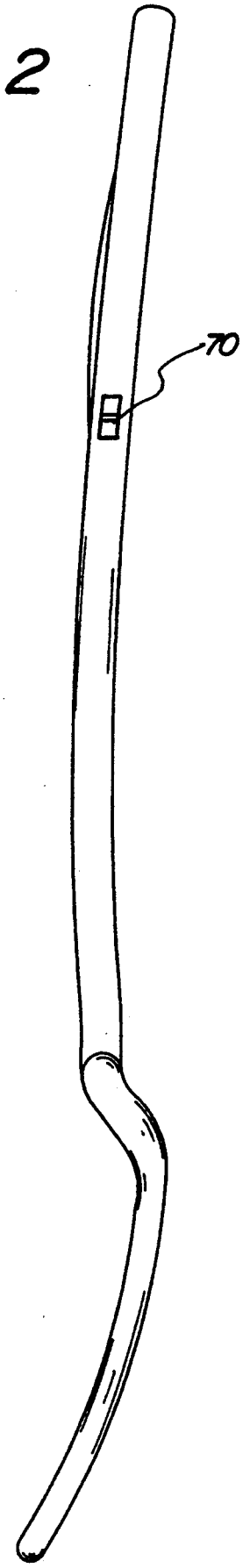
FIG. 2 is a side elevational view of the present invention depicted in FIG. 1.
Figure 5:
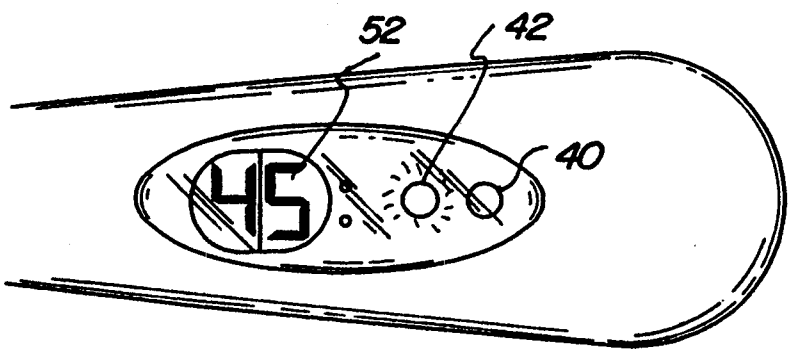
FIG. 5 is an enlarged view of the numeric display circuitry and the red and green light emitting diodes of the present invention with the numeric display indicating a reset time period after the initial countdown and the red light emitting diode shown activated, thereby indicating once again that another bite of food using the fork should not be taken.
Figure 4:
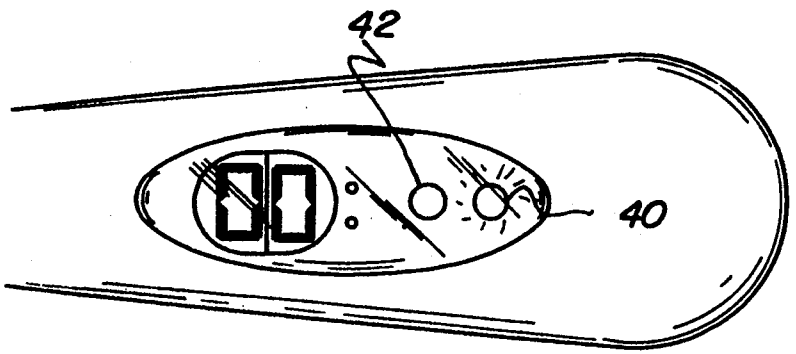
FIG. 4 is an enlarged view of the numeric display and the red and green light emitting diodes of the present invention with the numeric display indicating that the period of time has elapsed (countdown has been completed) and the green light emitting diode shown activated, thereby indicating that another bite of food using the fork may be taken.
Figure 3:
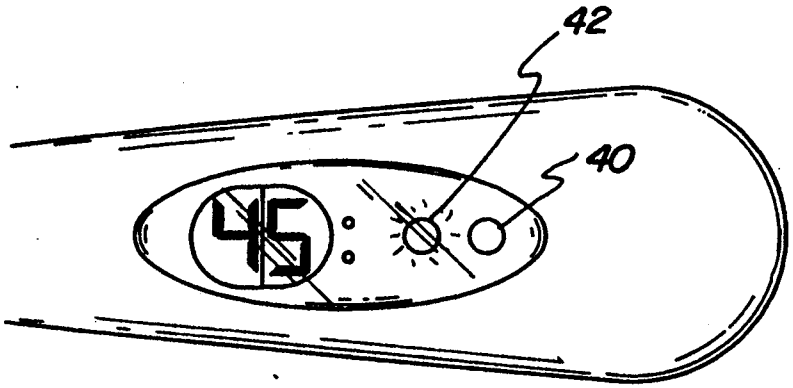
FIG. 3 is an enlarged view of the numeric display and the red and green light emitting diodes of the present invention with the numeric display indicating an initial period of time before countdown and the red light emitting diode shown activated, thereby indicating that another bite of food using the fork should not be taken.
Figure 6:
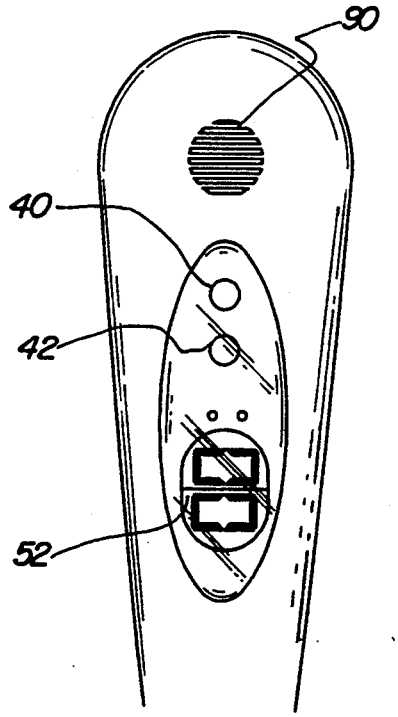
FIG. 6 is alternate embodiment of the present invention further including a speaker coupled to the handle for providing an audible indication of when another bite of food using the fork may be taken.

With reference now to the drawings, and in particular, to FIG. 1 thereof, the preferred embodiment of the new and improved fork with timer embodying the principles and concepts of the present invention and generally designated by the reference number 10 will be described.

Specifically, the present invention includes four major components. The major components are the dinner fork, timer circuitry, power source, and switch. These components are interrelated to provide the intended function.

More specifically, it will be noted in the various Figures that the first major component is the dinner fork 12. The fork is rigid in structure and formed of a material such as metal or plastic. The dinner fork has a head 14 with an extended surface. Four spaced and aligned tines 16 are extended from the head for holding food thereon. The tines of the dinner fork are generally curved. A handle 18 is extended from the head at a location remote from the tines for allowing the user a firm grip for taking a bite of food. The end of the handle is widened at the rounded and free end thereof and then tapered in towards the head.

The second major component is the timer circuitry 20. The timer circuitry is connected to the handle of the dinner fork. The timer circuitry is adapted for providing a cue to a user after an elapsed period of time for indicating to the user that another bite of food using the dinner fork may be taken. The timer circuitry includes four subcomponents. The four subcomponents are the countdown timer, decoder/driver circuitry, diodes, and display circuitry. These components are interrelated in their operation for providing the necessary cue to the user.

The first subcomponent of the timer circuitry is the countdown timer 22. The countdown timer is adapted for counting down a pre-programmed period of time. The countdown timer is adapted for transmitting countdown signals in sequence during this period of time. Furthermore, the countdown timer also transmits an event signal when the period of time being counted down has elapsed. Physically, the countdown signals and the event signal are electronic signals in the form of voltages and/or currents generated by the countdown timer. The countdown signals further represent values indicative of discrete values of time. The countdown timer further includes automatic reset circuitry. This automatic reset circuitry is used for resetting the pre-programmed period of time upon countdown completion. The reset circuitry thus allows subsequent countdown during a subsequent period of time. Thus, the countdown and reset functions of the timer circuitry are cyclical in nature. A countdown timer with automatic reset may be constructed of commercially available electronic components. Alternately, the countdown timer is commercially available in package form.

The second subcomponent of the timer circuitry is the decoder/driver circuitry 30. The decoder/driver circuitry is coupled to the countdown timer. The decoder/driver circuitry is adapted for receiving the countdown signals and event signals during and upon completion of a period of time as set by the timer circuitry. The decoder/driver circuitry is adapted to transmit a "go" signal when an event signal is received. Furthermore, the decoder/driver circuitry is adapted for transmitting a "stop" signal when an event signal is not received. The decoder/driver circuitry is also adapted for transmitting timer display signals upon receipt of countdown signals from the countdown timer. Physically, the "go" signal, the "stop" signal, and the timer display signals are electronic signal generated in the form of voltages and/or currents by the decoder/driver circuitry. Furthermore, the timer display signals have values adapted for driving an electronic and numeric display, and the "go" and "stop" signals have values adapted for driving light emitting diode or other similar illumination circuitry. The decoder/driver circuitry may be constructed of conventionally available electronic components. Alternately, the decoder/driver circuitry is commercially available in package form.

The third subcomponent of the timer circuitry is the diodes. The present invention includes a green light emitting diode 40 and a red light emitting diode 42. Each light emitting diode is coupled to the decoder/driver circuitry with the luminous portion thereof extended through the handle for viewing. The green light emitting diode is activated when the "go" signal is received, and deactivated otherwise. The red light emitting diode is activated when the "stop" signal is received and deactivated otherwise. The "go" signal and the "stop" signal are electronic signals having values characteristic for producing illumination from the particular light emitting diodes selected for use. When a period of time has elapsed, the green light emitting diode is activated and the red light emitting diode is deactivated. The green light emitting diode indicates that a bite of food may be taken. When a period of time has not elapsed, the red light emitting diode is activated and the green light emitting diode is deactivated. The red light emitting diode indicates that a bite of food should not be taken.

Lastly, the fourth subcomponent of the timer circuitry is the display circuitry 50. The display circuitry is coupled to the decoder/driver circuitry. The display circuitry has a numeric display 52 extended through the handle for viewing. The numeric display is adapted for transmitting a visual indication of elapsed time as it is being counted down. This visual indication is transmitted when timer display signals are received for actuating the internal display circuitry electronic components. The display circuitry is commercially available in package form.

The third major component is the power source 60. The power source consists of a replaceable and commercially available battery connected to the dinner fork and coupled to the timer circuitry. The power source is adapted for energizing the timer circuitry.

The fourth major component is the switch 70. The switch is connected to the handle of the dinner fork and coupled between the power source and timer circuitry. The switch has one orientation for energizing the timer circuitry to place the present invention in operation. The switch has another orientation for de-energizing the timer circuitry.

Figure 7:
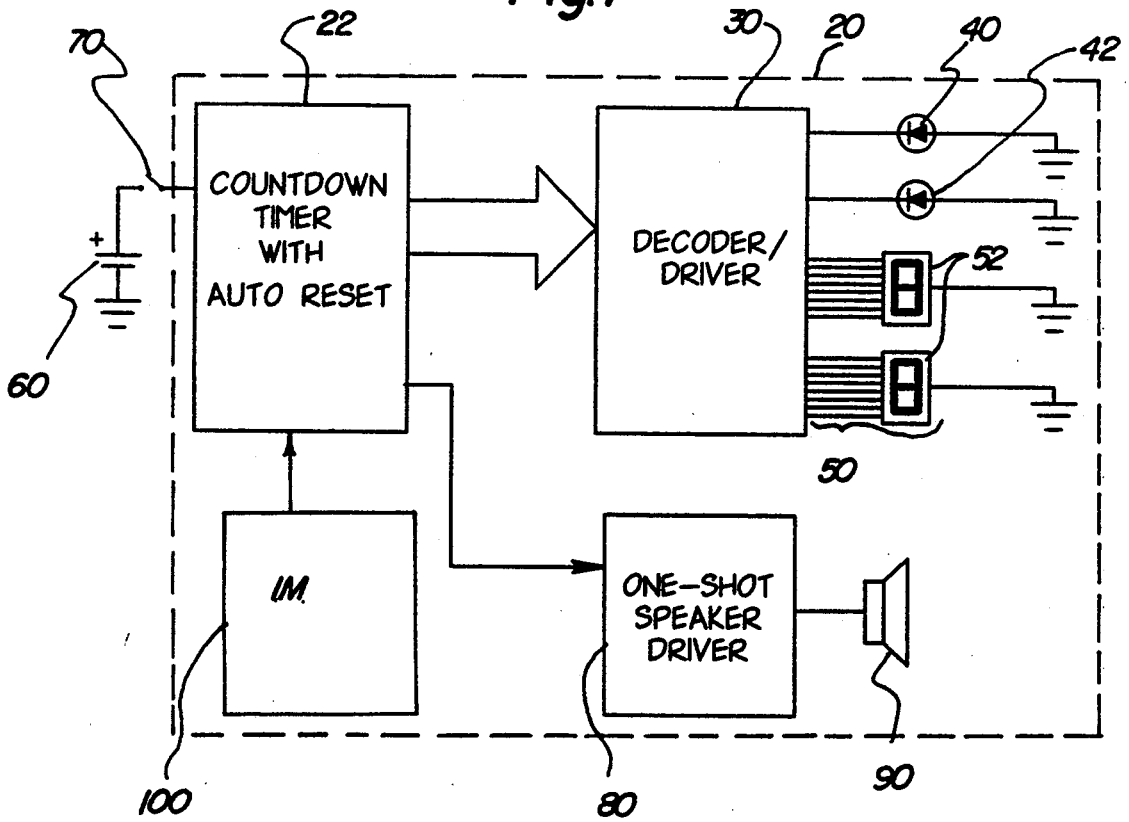
FIG. 7 is a functional block diagram of the timer circuitry of the present invention. In the preferred embodiment of the present invention, the one-shot speaker driver and speaker are not included. In an alternate embodiment of present invention as shown in FIG. 6, the one-shot speaker driver and speaker are included and coupled to the handle.

A second embodiment of the present invention is shown in FIG. 7 and includes substantially all of the components of the present invention further including a one-shot speaker driver and a speaker. The one-shot speaker driver 80 is coupled to the countdown timer. It is adapted to transmit a speaker activation signal upon receipt of an event signal generated by the countdown timer. Physically, the speaker activation signal is an electronic signal in the form of a voltage and/or current generated by the one-shot speaker driver. The speaker 90 is connected to the handle and coupled to the one-shot speaker driver. The speaker is adapted for transmitting an audible tone or chime based upon receipt of a speaker activation signal. In this embodiment, a visual as well as audible cue is provided to the user.

A third embodiment of the present invention includes substantially all of the components of the first and second embodiments further including interface means 100 coupled to the timer circuitry. The interface means is adapted to be accessible by a user. The interface means is used for adjusting the pre-programmed period of time resident in the timer circuitry. By manipulating the interface means, a user can adjust the pre-programmed time as desired.

Many people eat very rapidly, especially overweight people who are binge eaters. They do so unconsciously, especially when eating and/or talking with others and are not aware of what they are doing or how much they are consuming. Eating slowly is healthier and gives a person time to enjoy the food, which also tends to reduce their appetite, thus the amount they eat. However, getting a person to slow down is difficult, as it takes conscious thought to eat slowly when hungry. The present invention can assist people to be more aware of their eating habits and pace themselves between bites, thus slowing down their rate of consumption and helping them change their eating habits to more healthy and enjoyable ones.

The present invention is a standard 4-prong dinner fork made of stainless steel and an oval cutout in the handle. A waterproof solid state countdown timer is inserted and securely fastened into the cutout. The timer has a 2-digit display that counts down once a second from a preset period of up to 99 seconds, and two light emitting diodes, one red and the other green, that glow depending on the countdown state. While the time is counting down the red light emitting diode is turned on. When the count reaches zero, the red light emitting diode turns off and the green light emitting diode is turned on to indicate it is time to take another bite. The timer is powered by a small calculator battery that can be replaced when necessary. It can be accessed through the bottom side of the dinner fork handle. The access door has a durable silicone seal to make it waterproof. An alternate embodiment of the present invention also emits an audible beep or chime that indicates when the count of the time reaches zero.

This is a fork that helps people pace their eating. It would be useful for dieters, health conscious people and everyone who wants to break the habit of eating too fast. The fork has a countdown timer in the handle and red and green lights that let the user know when it is "time" to take the next bite. Deluxe versions could have a chime and beep. This invention assists in altering the habitual nature of eating "unconsciously," a feature of nearly every diet program. This invention could be truly helpful to people and extremely appealing since it does not require denial or starvation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A fork with timer for providing a cue to a user after an elapsed period of time for indicating that another bite of food using the fork may be taken comprising, in combination:

a rigid dinner fork having a head, four spaced and aligned tines extended from the head, and a handle extended from the head remote from the tines for allowing a user a firm grip for taking a bite of food;

timer circuitry connected to the handle of the dinner fork and adapted for providing a cue after an elapsed period of time for indicating to user that another bite of food using the dinner fork may be taken, the timer circuitry further comprising:

a countdown timer adapted for counting down a pre-programmed period of time, transmitting countdown signals in sequence during this period of time, and transmitting an event signal when this period of time has elapsed, the countdown timer including automatic reset circuitry for resetting the pre-programmed period of time upon countdown completion for subsequent countdown during a subsequent period of time;

decoder/driver circuitry coupled to the countdown timer and adapted for receiving the countdown signals and event signals during and upon completion of a period of time, transmitting a "go" signal when an event signal is received, transmitting a "stop" signal when an event signal is not received, and transmitting timer display signals upon receipt of countdown signals;

a green light emitting diode and a red light emitting diode each coupled to the decoder/driver circuitry with the green light emitting diode activated when the "go" signal is received and deactivated otherwise, the red light emitting diode activated when the "stop" signal is received and deactivated otherwise, whereby when a period of time has elapsed, the green light emitting diode is activated and the red light emitting diode is deactivated, and when a period of time has not elapsed, the red light emitting diode is activated and the green light emitting diode is deactivated; and display circuitry coupled to the decoder/driver circuitry with the display circuitry having a numeric display for transmitting a visual indication of elapsed time based upon receipt of timer display signals;

a replaceable power source connected to the dinner fork and coupled to the timer circuitry with the power source adapted for energizing the timer circuitry; and a switch connected to the handle of the dinner fork and coupled between the power source and the timer circuitry with the switch having one orientation for energizing the timer circuitry and another orientation for de-energizing the timer circuitry.

2. The fork with timer as set forth in claim 1 further comprising:

a one-shot speaker driver coupled to the countdown timer and adapted to transmit a speaker activation signal upon receipt of an event signal; and a speaker connected to the handle and coupled to the one-shot speaker driver with the speaker adapted for transmitting an audible tone based upon receipt of a speaker activation signal.

3. A fork with timer for providing a cue to a user after an elapsed period of time for indicating that another bite of food using the fork may be taken comprising:

a dinner fork having a head, a plurality of spaced tines extended from the head, and a handle extended from the head remote from the tines;

timer circuitry connected to the handle of the dinner fork and adapted for providing a cue after an elapsed period of time for indicating to user that another bite of food using the dinner fork may be taken, the timer circuitry further comprising:

a countdown timer adapted for counting down a pre-programmed period of time, transmitting countdown signals in sequence during this period of time, and transmitting an event signal when this period of time has elapsed, the countdown timer including automatic reset circuitry for resetting the pre-programmed period of time upon countdown completion for subsequent countdown during a subsequent period of time;

decoder/driver circuitry coupled to the countdown timer and adapted for receiving the countdown signals and event signals during and upon completion of a period of time, transmitting a "go" signal when an event signal is received, transmitting a "stop" signal when an event signal is not received, and transmitting timer display signals upon receipt of countdown signals;

a green light and a red light each coupled to the decoder/driver circuitry with the green light activated when the "go" signal is received and deactivated otherwise, the red light activated when the "stop" signal is received and deactivated otherwise, whereby when a period of time has elapsed, the green light is activated and the red light is deactivated, and when a period of time has not elapsed, the red light is activated and the green light is deactivated; and display circuitry coupled to the decoder/driver circuitry with the display circuitry having a display for transmitting a visual indication of elapsed time based upon receipt of timer display signals;

a replaceable power source connected to the dinner fork and coupled to the timer circuitry with the power source adapted for energizing the timer circuitry; and a switch connected to the dinner fork and coupled between the power source and the timer circuitry with the switch having one orientation for energizing the timer circuitry and another orientation for de-energizing the timer circuitry.

4. The fork with timer as set forth in claim 3 further including interface means coupled to the timer circuitry and adapted to be accessible by a user for allowing the pre-programmed period of time to be set as desired.

* * * * *